US006895696B1

(12) United States Patent
Sanders

(10) Patent No.: US 6,895,696 B1
(45) Date of Patent: May 24, 2005

(54) PROTECTIVE SHOELACE STORAGE COMPARTMENT

(76) Inventor: Aric Sanders, 9995 Carmel Mountain Rd., Ste. B-10, San Diego, CA (US) 92129

( * ) Notice: Subject to any disclaimer, the term of this patent is extended or adjusted under 35 U.S.C. 154(b) by 0 days.

(21) Appl. No.: 10/356,147

(22) Filed: Jan. 31, 2003

Related U.S. Application Data

(60) Provisional application No. 60/354,000, filed on Feb. 1, 2002.

(51) Int. Cl.[7] ..... A43B 23/00
(52) U.S. Cl. ..... 36/54; 36/136; 24/712.1
(58) Field of Search ..... 36/54, 136; 24/712.1, 24/712.2, 712.3

(56) References Cited

U.S. PATENT DOCUMENTS

| | | | | |
|---|---|---|---|---|
| 1,371,637 | A | 3/1921 | Meredith | |
| 2,871,537 | A | 2/1959 | Hickerson | |
| 3,473,198 | A | 10/1969 | Meier | |
| 3,940,873 | A | 3/1976 | Lawless | |
| 4,372,060 | A * | 2/1983 | Adamik | 36/54 |
| 4,416,315 | A | 11/1983 | Foley | |
| 4,630,383 | A * | 12/1986 | Gamm | 36/136 |
| 4,749,113 | A | 6/1988 | Grubman | |
| 4,805,321 | A * | 2/1989 | Tonkel | 36/54 |
| 4,955,150 | A * | 9/1990 | Fagan | 36/136 |
| 4,999,888 | A | 3/1991 | Miller | |
| 5,042,119 | A | 8/1991 | Williams | |
| 5,094,016 | A * | 3/1992 | DiVito | 36/136 |
| 5,170,573 | A | 12/1992 | Clinch | |
| 5,566,477 | A | 10/1996 | Mathis et al. | |
| 5,649,342 | A | 7/1997 | D'Andrade et al. | |
| 5,671,517 | A | 9/1997 | Gourley | |
| 5,718,021 | A | 2/1998 | Tatum | |
| 5,778,500 | A | 7/1998 | Illingworth | |
| 6,000,111 | A | 12/1999 | Deskins et al. | |
| 6,408,542 | B1 * | 6/2002 | Shepherd | 36/54 |
| 6,449,881 | B1 * | 9/2002 | Assaf et al. | 36/136 |

* cited by examiner

*Primary Examiner*—Marie Patterson
(74) *Attorney, Agent, or Firm*—Donn K. Harms

(57) ABSTRACT

With the advent of the protective shoelace storage compartment incorporated within the new designs of the sports footwear, the shoes will appear less cluttered with the bow and lace ends concealed or all the laces, the bow and lace ends concealed. Without the laces dangling those individuals engaged in active sports like skateboarding will not have to worry about the laces of their shoes getting tangled in the wheels of the skateboard. The shoelace storage compartment may be closed by means of a zipper on the preferred embodiment or the hook loop fastening means on the alternate embodiment. The novelty of this invention is the added benefit of the concealed storage compartment for articles like identification, driver's license or money for those in sportswear not having any pockets or those traveling where additional precautions are necessary.

14 Claims, 1 Drawing Sheet

PROTECTIVE SHOELACE STORAGE COMPARTMENT

This application claims the benefit of U.S. Provisional Application No. 60/354,000, filed Feb. 1, 2002.

FIELD OF THE INVENTION

The disclosed device relates to the field of shoes. More particularly, but not limited to the field of athletic footwear, the invention will be incorporated as an integral or removable part of the shoe structure. This unique invention forms a combination storage compartment and protective cover for the distal ends of shoelaces used to secure shoes on the foot of a wearer by creating a compartment within the tongue of the shoe that may be sealed by the means of hook loop fastener, a conventional zipper, snaps or buttons. When properly sealed the compartment is visually virtually indistinguishable from a normal tongue and therefor provides both a hidden pocket as well as a compartment covering the tied shoestrings protecting them from damage and dislodgement.

BACKGROUND OF THE INVENTION

This invention describes a new and unique protective shoelace storage compartment that is an integral part of the shoe where the shoelaces may be confined and articles like personal identification, driver's license or money may be conveniently stored in a similar fashion to that of a money belt.

Conventional shoes worn by millions of people worldwide are laced up to secure them on the feet. The distal ends of the laces are then tied in a bow to keep the laces tightly secured in the shoe and the shoe thus secured on the foot of the wearer. The problem encountered by many shoe wearers is the bow at the distal end of the laces becomes loose from abrasion or is not tied firmly enough or just gets loose and in the way. This is especially true of sports shoes worn for athletic endeavors like running, jumping, and skateboarding. The bows on the laces of the shoes of an individual, especially in skateboarding, are prone to coming untied and becoming entrapped in the wheels of the skateboard and otherwise interfering with the performance of the rider of the skateboard. The athletic shoes that use a hook-loop fastening means instead of the laces do not tighten sufficiently, nor do they hold under the stress and abrasion created in any of the extreme activities of today's sports.

As such, there is a pressing need for a device that will allow the user of such shoes to lace them tightly and tie the distal ends in a bow inside of a compartment. When enclosed in the compartment even under the high stress environment of modern sporting activities, the user is secure in the knowledge that the ties will not become entangled or undone, especially when riding a skateboard or participating in other athletic activities which will might the laces to come free.

Additionally, people traveling for years have found it convenient to carry a money belt to secure some of their valuables like personal identification, driver's license or money when they felt that they were in an area of high theft. Pickpockets generally go after the wallet which is most often carried in a convenient location. Many of the younger, more active generation do not have pockets in their sportswear in which to carry wallet or valuables and often leave them laying around while they are participating in an activity. Even if an individual is carrying a wallet, it may be advisable to carry some additional valuables or personal identification in a separate location in case the wallet becomes lost. The hidden, and large compartment provided by the closure means on the endwall of the tongue provides a perfect hiding place for a wallet or other valuables. With the closure means on the endwall of the tongue, easy access is provided to the entire length of the tongue, and the pocket remains virtually invisible and hidden to prying eyes. Furthermore, this unique protective shoelace storage compartment imparts a new, cleaner and more aesthetically pleasing look to the design of the shoes and provides a means to held the tongue in place in line with the two sides of the shoes by the provision of two eyelets through which the laces are drawn to register the tongue in the proper position between the right and left sides of the shoe.

U.S. Pat. No. 1,371,637 of C. B. Meredith describes an invention that is a shoe string holder arranged to he fastened over the ends of the laces of a shoe for preventing the untying of the laces and to provide a neat and ornamental but practical device of this character. This is a device separate from the shoes that is used as an ornament for securing the bow and shoe laces.

U.S. Pat. No. 2,871,537 of F. R. Hickerson teaches of a fastener of tightener for laced closures. It is particularly adapted to use on the laces of shoes. This is another device to be used over the laces on a pair of shoes.

U.S. Pat. No. 3,473,198 of E. Meier describes an enclosure that is adapted to be attached to a shoe in such a manner so that the tie of the shoe can be locked within the enclosure. The enclosure is formed of two halves, which are hingeably attached to one another and is provided with a hidden latching means, which requires the use of a thin object such as a coin to be unlocked. This again is a device separate from the shoes used to conceal the tie and laces of a pair of shoes.

U.S. Pat. No. 4,416,315 of Foley additionally describes a device for carrying valuables comprising a closeable container, such as a wallet or purse, having a hanger member, such as a flexible and resilient clip, movably secured thereto. One end of the hanger member is movably secured to a hanger support member that is movably mounted within the container. One end of the container is provided with an aperture through which a portion of the hanger member is moved when it is disposed in an inner or retracted position wherein the hanger member can engage the adjacent portion of a pocket or the like in which the container is placed. The hanger member is movable to an outer or extended position out of the container wherein the hanger member may be positioned over a garment hem and under the belt of the user with the container hanging inside the garment and below the belt. Means are provided on the container and on the support member for releasably maintaining the support member and the hanger member in the inner or retracted position. Although this device has been designed to carry valuables, it is not incorporated into the design of a pair of shoes and will not conceal the bow and laces of the shoes.

U.S. Pat. No. 4,749,113 of Grubman describes a clip having a flat money-container suspended therefrom and is clipable onto an upper edge of upright trousers, such that the money container is suspended inside the trousers below the upper edge thereof. Affixed to the clip is ornamental material shielding the clip from exterior discernment and an additional securing strip affixed to the clip and the money-container with another clip affixed to the free distal end of the strip adapted to be clipped onto clothing, all as a combination, and there being two such combinations with the strips thereof crossing and threaded through a buckle, in the nature of a belt or a cummerbund or as suspenders. This is another device designed to conceal a container for valuables, but it has no relationship to shoes.

U.S. Pat. No. 4,999,888 of Cathy S. Miller discloses a shoelace retainer that includes a flexible, elongated strap member having a plurality of hook fastener elements on one surface thereof and a plurality of complementary loop fastener elements on an opposite surface thereof. A tab member having an elongated slot is disposed at a first end of the strap member for attaching the strap member to the footwear. The free ends of the shoelace are passed through the slot and the ends are tied in a conventional bowknot. The bow loops and free ends of the shoelace are placed on top of the strap member and the strap member is rolled up and onto itself, whereby the hook fastener elements become interlocked with the loop fastener elements, thereby confining the bow loops and free ends between convoluted layers. This is another invention that describes a device separate from the shoes to cover and enclose the tie and laces and not being an integral part of the shoe design.

U.S. Pat. No. 5,042,119 of Timothy G. Williams tells of devices and methods for containing tied lace ends on footwear. Each tied lace ends containment device comprises members which affix the device to a shoe, enclose otherwise loose tied lace ends including the bow to eliminate or greatly alleviate the danger and annoyance of freely dangling lace ends, and firmly securely engage the tie lace containment. A pocket is disclosed provided for conveniently carrying valuables or other small items on the footwear during an activity. Opportunity for placement of fashionable designs or personal identification or the like is provided. Although this device covers the laces and provides a pocket for confidently carrying valuables, this is another invention that describes a device separate from the shoe design itself, not being a unique integral part of the design of the shoes. Any of the devices listed in the prior art provided designed to cover the laces have the ability of storing articles.

U.S. Pat. No. 5,170,573 of Aubrey Clinch teaches of a miniature pouch device which is removably attachable to the instep of a shoe for captivating the lace and bow used to tie the shoe, and retain them in a neat small package, which sits in the location where the bow would normally reside on a conventional pair of shoes. This is another invention that describes a device separate from the shoes to cover and enclose the tie and laces, not being an integral part of the shoe design.

U.S. Pat. No. 5,566,477 of Leroy Mathis describes a shoelace cover incorporating an interchangeable fashion panel for covering the shoelaces of a gym shoe. The shoelace cover is secured to the shoe by a number of straps threaded through slots in the shoelace cover. A strap secured to each side of the gym shoe includes a loop and hook material such that the straps can be disengaged and the shoelace cover can be drawn back to expose the shoelaces of the shoe. The fashion panel is attached to the shoelace cover by a loop and hook material such that at the whim of the shoe wearer the fashion panel can be replaced by other fashion panels to convey a fashion statement. This is still another invention that describes a device separate from the shoes to cover and enclose the tie and laces and not being an integral part of the shoe design.

U.S. Pat. No. 5,649,342 of Bruce M. D'Andrade et al. discloses a device for securing shoelaces includes a base, a cover and an attachment mechanism for hingedly connecting the base and cover. The base has at least a bottom, a front and a back. The bottom has side cutouts adapted to allow a shoelace to pass therethrough. A pair of opposing slits extends from the side cutouts towards the center, but do not overlap. The opposing slits are formed so that the shoelace may pass easily from the side cutouts to the opposing slits. Each slit is sized and shaped such that it frictionally engages the shoelaces when they are pulled through it. In a further embodiment, the present invention has a support structure, which can be attached to the footwear and then coupled with the base. In this embodiment, the base and support have complementary attachment mechanisms. This is still another invention that describes a separate device from the shoes to cover and enclose the tie and laces and not being an integral part of the shoe design.

U.S. Pat. No. 5,671,517 of Mervin Gourley describes a shoelace safety guard as a device to cover and retain the shoelaces to prevent inadvertent snagging or other interference with the laces when wearing shoes. An inner fastener element is attached by a tab to the shoelace at the furthest lace away from the point at which the laces are tied. The shoelaces are then tied by a bow over the inner fastener element. An outer fastener element attached at a fold is then folded over onto the inner fastener element and retained by a hook and loop material to cover and retain the laces. The outer fastener element may have hook and loop material to allow attachment of emblems, reflectors and other objects. This is still another invention that describes a device separate from the shoes to cover and enclose the tie and laces and not being an integral part of the shoe design.

U.S. Pat. No. 5,718,021 of Richard G. Tatum discloses a device for tying a shoelace on a shoe, the shoelace having a first end and a second end. The device includes a base and a cover hingedly mounted on the base so as to be pivotable between an open position and a closed position. The base includes a top surface, a bottom surface and first and second holes, which are sized and shaped so that the shoelace can be inserted therethrough. The cover includes a top surface, a bottom surface and first and second pins, which are aligned so as to project into the first and second holes, respectively. When the cover is in the closed position. The cover also includes a locking tab, which engages with a tip on the base to releasably lock the cover in the closed position. In use, with the first and second ends of the shoelace inserted through the first and second holes, respectively, with the base seated on top of and in direct contact with the shoe and with said cover pivoted in the closed position, said device prevents the shoelace from loosening within the shoe. This is still another invention that describes a device separate from the shoes to cover and enclose the tie and laces and not being an integral part of the shoe design.

U.S. Pat. No. 5,778,500 of Moise Illingworth tells of a knot securing device of particular benefit in securing shoelace knots made from a flexible material with a region having hook elements, a region having loop elements and a pair of apertures in the flexible material for allowing the open ends of a shoelace to pass through from one surface of the material to the opposite surface of the material. The shoelace is then tied in a knot and the regions with the hook and loop elements are brought into contact to form a secure, but releasable lock around the knot. This is still another invention that describes a device separate from the shoes to cover and enclose the tie and laces and not being an integral part of the shoe design.

U.S. Pat. No. 6,000,111 of R. Timothy Deskins et al. describes a device for containing, concealing and protecting footwear fasteners to keep the fasteners secure, clean, concealed and protected from snagging on foreign objects. The device is made of a pliable material so as to prevent injury in the event that the wearer or some other person comes into contact with the device. The device has a cover that may display fashionable designs and emblems, or reflective material for use in the dark. This is still another invention that describes a device separate from the shoes to cover and enclose the tie and laces and not being an integral part of the shoe design.

The forgoing prior art discloses a vast array of devices to cover or protect the laces of a conventional pair of shoes. However, there exists a need for a shoe having a hidden pocket in the tongue which is aesthetically pleasing and functionally hides the access point to the pocket. Such a device should provide easy access to the hidden pocket from a side edge thereby allowing easy insertion of a wallet or money or similar valuables. Such a device should also provide a closure means on the endwall of the tongue which allows the outer surface of the two walled tongue to be folded forward to allow the laces to actually be tied inside the area of the tongue which forms the pocket. Such a device should optionally be removable from the shoe itself to function as a wallet. Finally, such a device should provide a means to maintain the registration of the tongue between the two sides of the shoe during use of the shoe by using the laces to hold it in proper positioning once tied.

SUMMARY OF THE INVENTION

The present invention accomplishes its desired objects by providing a protective shoelace storage compartment within the tongue of the shoe, either fixed permanently or detachably engaged with a conventional pair of athletic shoes. It must be understood that this invention is not limited just to athletic shoes alone but may be used on any style of shoes and still remain within the scope of this patent. However, with the advent of extreme sports and gym use noted above, sports shoes would be the current best mode of the device.

This protective shoelace storage compartment within the tongue of the shoes consists of a compartment with an outside surface and an inside surface attached together and to the shoe by sewing or other conventional attachment means. An alternate embodiment of the invention could have the shoelace storage compartment removably attachable to the shoe by the means of hook loop fastening within the shoe at the toe end of the lace opening. The shoelace storage compartment will have an opening at the uppermost distal endwall of the tongue that will have a zipper, snaps, buttons or hook-loop closure means. Placement in the endwall in the current best mode of the device renders the pocket virtually indistinguishable from a conventional non-pocket tongue and also give easy access to the pocket to tie the laces inside the pocket before closure of the zipper or other closure means on the endwall.

One or a plurality of eyelets will translate up the sides of the shoelace storage compartment thereby providing a means to register the tongue inline in-between the two sides of the shoe body. In the case of having a single eyelet on either side, the laces are drawn into the compartment at the uppermost distal end to be tied and stored within the compartment before it is sealed with the additional lacing visible on the outside of the storage compartment. In the case where the shoelace storage compartment has a plurality of eyelets up either side, the laces are woven through the length of the compartment terminating at the upper most distal end of the compartment to be tied and stored within the compartment before it is sealed producing a cleaner and more unique new look to the shoes. The tongue will have the shape and appearance of the conventional tongue of the shoe, wherein the tongues of the athletic shoes are heavily padded and extend out longer than other shoes, the closure means is easily concealed, and the storage compartment can be large enough to hold the keys to a vehicle.

Accordingly, it is the object of this invention claimed herein to provide protection of tied distal ends of shoelaces to prevent their coming untied or entangled with sports equipment being used by the wearer.

It is another object of this invention to supply a compartment to maintain the bow formed by actually tying the distal ends of shoelaces therein before sealing the compartment endwall.

Still another object of this invention is to provide the containment of the bow and distal ends of shoelaces inside a compartment and thus away from entanglement of the user's feet during any sporting activity.

It is a further object of this invention to provide for the elimination of problems inherent with current shoelaces on shoes when the user is engaged in skateboarding or other athletic endeavors where entanglement of the laces with the device being ridden or operated can be dangerous.

It is still a further object of this invention to supply a location within the tongue of a pair of shoes, which once closed is hidden, to store valuables and personal items.

It is a final object of this invention to further enhance and develop the ever-growing market of sporting shoes along with developing a new and unique style of shoes.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWING FIGURES

The accompanying drawings, which are incorporated in and form a part of this specification, illustrate embodiments of the invention and together with the description, serve to explain the principles of this invention.

DETAILED DESCRIPTION OF THE DRAWING FIGURES

Figure 1:
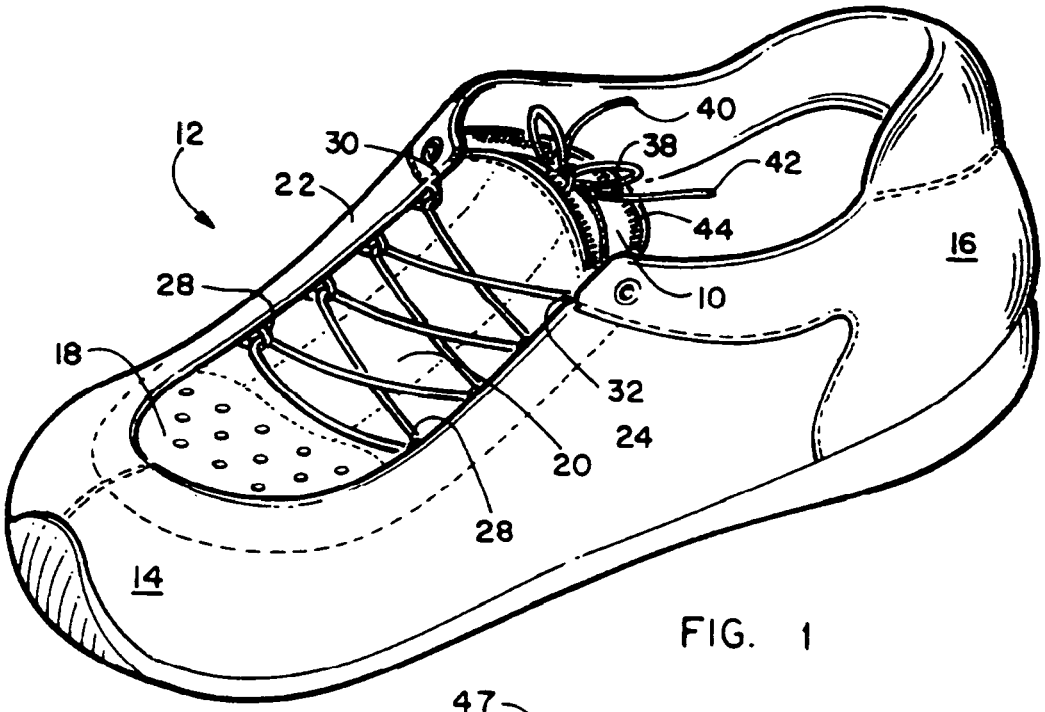
FIG. 1 depicts a perspective view of a the disclosed device on a sports shoe with the bow and laces extending from the un-zippered pocket through the aperture in the endwall in the tongue of the shoe.

Referring now to the drawings 1–3, wherein similar parts of the protective shoelace storage compartment 10 are identified by like reference numerals, there is seen in FIG. 1 a single sports shoe 12 which would normally be one of a pair of shoes, indicating the toe section 14 and the heal section 16. The disclosed device can be either used in an entirely new shoe design or as an add on to existing shoe designs.

Figure 2:
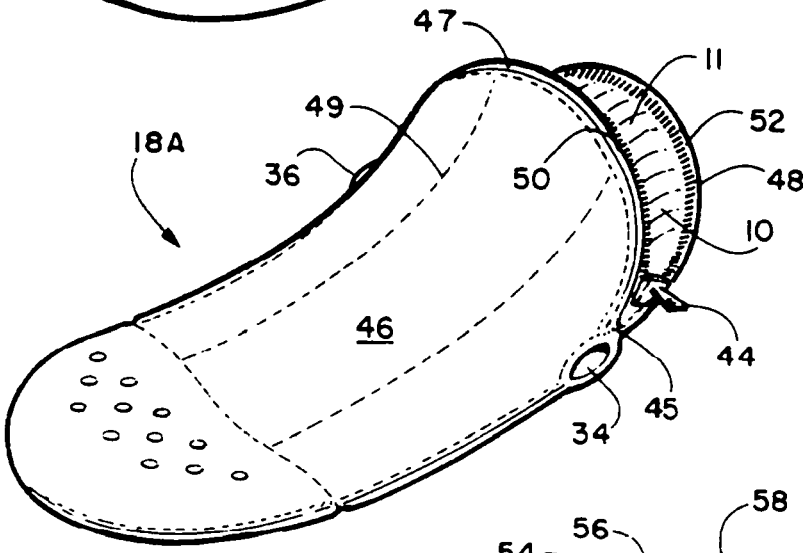
FIG. 2 depicts a tongue of a shoe incorporating a zippered compartment means.

The sports shoe 12, having a tongue 18A, as best shown in FIG. 2, features a zipper 44 attached to the upper endwall 45 of the tongue 18A providing a means of closure of the storage compartment aperture 11 and generally fills the tongue gap 20 between the right side 22 and the left side 24 of the toe section 14. In use incorporated into a shoe 12, the shoelaces 26 weave up the tongue gap 20 from the lower extremity of the laces 28 to the uppermost shoelace hooks 30 and 32. Of course those skilled in the art will realize that grommets or eyelets or formed apertures might also be used for the hooks 30 and such is anticipated. Adjacent to the hooks 30 and 32, the shoelaces 26 are inserted through shoelace eyelets 34 and 36 in the tongue 18 providing a communicating passage into the storage compartment 10 for the shoelaces 26. Once threaded through the eyelets 34 and 36 the distal ends of the shoelaces 26 terminate at conventional shoelace bow 38 or any other form of knot with the shoelace ends 40 and 42 extended. This bow is actually tied by the user inside the storage compartment 10 by spreading the storage compartment aperture 11, or by folding over the outer edge flap 50 when the endwall 45 is curved in shape, thereby providing easy access to the inside of the storage compartment 10 to actually tie the shoelaces 26 in place in the storage compartment 10.

Optionally, a plurality of additional eyelets 34 and 36 can be located along the sides of the tongue 18A for concealing all the laces within the protective shoelace storage compartment 10 if desired to protect them from abrasion and from accidental entanglement with equipment or for aesthetic purposes. For the preferred embodiment of the invention illustrated in FIG. 2, the protective shoelace storage compartment 10 has a zipper 44 as a means of closure which is mounted in the endwall 45 of the tongue 18A between the outer surface 46 and the inner surface 48 with only single eyelets 34 and 36 located adjacent to ends of the zipper 44. The outer edge flap 50 and the inner edge flap 52 conceal the zipper and the storage compartment 10 after the protective shoelace storage compartment 10 has been closed by closing the zipper 44. Placed in the endwall 45 the zipper 44 becomes virtually indistinguishable from adjacent fabric of the shoe, and almost indeceptable if the zipper 44 has a fabric flap 47 overlay which conceals the zipper when closed.

In addition to concealing the access point to the storage compartment 10, placement of the zipper 44 in the endwall 45 forms an aperture 11 which provides an inline access to the entire storage compartment 10 making it much easier to insert valuables or wallets, or other things to be stored in the storage compartment 10. Further, in the current best mode of the device utility is enhanced by curving the aperture 11 which is closed by the zipper 44 or other means for closure of the aperture 11, an upper section 49 of the outer surface 46 forming one sidewall of the storage compartment 10 is provided. This upper section 49 is easy to fold forward slightly when tying the shoelaces 26 inside the storage compartment 10 thereby making it much easier for the user to tie the shoelaces 26 tightly by folding the upper section 49 forward. This curved aperture 11 in the endwall 45 also allows the user to fold forward the upper section 49 when inserting or retrieving money, identification, or other materials which are located in the storage compartment 10 during insertion or retrieval and forms an upper pocket section that may be accessed by simply opening the zipper 44 or other closure means and folding the upper section 49 away from the inner surface 48 making up the other sidewall of the tongue. When the laces are tightly engaged over the rest of the tongue 18A, this upper pocket section may still be easily accessed and is excellent for placing ID cards or money in for easy access even when the shoelaces 26 are tightly engaged with the tongue 18A and tied.

Figure 3:
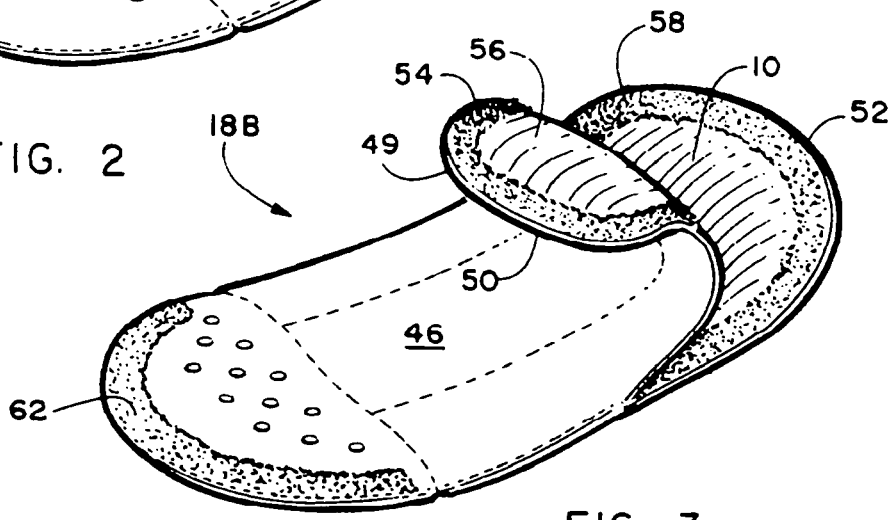
FIG. 3 depicts a tongue of a shoe incorporating a compartment with a hook loop fastening means.

An alternate preferred embodiment illustrated in FIG. 3 depicts the tongue 18B with a hook loop fastening means in place of the zipper 44 providing a closure of the aperture 11 providing access to the protective shoelace storage compartment 10. The hook section 54 is depicted as attached to the inside 56 of the outer surface 46 while the loop section 58 is shown attached to the inside 60 of the inner surface 48, however the placement could be reversed. The aperture 11 formed in the sidewall closed by the hook and loop fabric is still best curved in shape to provide the upper section 49 that folds forward to provide easy access to tie the laces 26 as well as easy access to the upper section of the tongue 18B even when the laces are tied tightly for placement of articles in the upper section. Also depicted is the hook-loop attachment 62 to be used to attach the protective shoelace storage compartment 10 within gap 20 of the sports shoe 12. This hook-loop attachment 62 would be used optionally on either embodiments of the tongue should the ability to totally remove and reattach the tongue 18 be desired so that the tongue itself can be carried as a wallet.

While all of the fundamental characteristics and features of the protective shoelace storage compartment have been shown and described, it should be understood that various substitutions, modifications, and variations may be made by those skilled in the art without departing from the spirit or scope of the invention. Consequently, all such modifications and variations are included within the scope of the invention as herein disclosed in drawings and other enclosures and defined by the following claims.

What is claimed is:

1. A protective shoelace storage compartment in a shoe having a toe end and a heal end and having a tongue situated in a tongue gap between two side sections of a shoe, comprising:

said tongue having an outer sidewall and an inner sidewall;

said outer sidewall and said inner sidewall joined along a first side edge and a second side edge and at an attachment edge;

means for attachment of said attachment edge adjacent to said toe end of said shoe;

said tongue having an aperture formed in an endwall edge, between said inner sidewall and said outer sidewall, opposite said attachment edge, said aperture extending along said endwall edge between a pair of opposing tongue openings in respective opposing positions in said first side edge and second side edge, adjacent to said endwall edge;

said aperture providing access to the entire length of a storage pocket, said storage pocket defined by said area between said inner sidewall and said outer sidewall, said first side edge, said second side edge, said attachment edge, and said endwall edge;

means for releasable closure of said aperture;

said pair of opposing tongue openings providing communication to said aperture for the distal ends of a shoelace used to secure said two side sections of said shoe, said shoelace crossing over said outer sidewall from said attachment edge to respective engagements of said distal ends through said tongue openings;

said pair of opposing tongue openings engaged with said distal ends of said shoelace providing a means to maintain said tongue inline in said tongue gap from said attachment edge to said endwall edge; and an upper section of said storage pocket defined by the area between said tongue openings and said pair of sidewalls and said endwall edge, whereby said distal ends of said shoelace may be tied inside said upper section and said aperture closed thereby securing said distal ends inside said storage pocket.

2. The protective shoelace storage compartment of claim 1 further comprising:

said aperture formed in said endwall edge, and continuing for a length down both of said first side edge and said second side edge adjacent to said endwall, thereby forming a flap section on said outer sidewall adjacent to said endwall; and said flap foldable away from said inner sidewall thereby providing access to said upper section of said storage pocket from the direction of said outer sidewall.

3. The protective shoelace storage compartment of claim 2 wherein said means for releasable closure of said aperture comprises:

a zipper having first and second sides attached to said aperture in said endwall edge and continuing said length down both of said first side edge and said second side edge adjacent to said endwall;

a fabric overlay covering said first and second sides of said zipper; and said fabric overlay substantially covering said zipper entirely when said zipper is moved to a closed position with said first and second sides engaged thereby hiding said aperture from view.

4. The protective shoelace storage compartment of claim 3 wherein said means for attachment of said attachment edge adjacent to said toe end of said shoe is a means for releasable attachment whereby said tongue may be removed and reattached to said shoe.

5. The protective shoelace storage compartment of claim 4 further comprising:

a plurality of said pair of opposing tongue openings formed in respective opposing positions in said first side edge and said second side edge of said tongue; and said shoelace threadable through said plurality of said pair of tongue openings to a criss-crossed engagement over said inner sidewall, from said attachment end toward said aperture, wherein substantially all of said shoelace may be enclosed in said storage pocket.

6. The protective shoelace storage compartment of claim 2 wherein said means for attachment of said attachment edge adjacent to said toe end of said shoe is a means for releasable attachment whereby said tongue may be removed and reattached to said shoe.

7. The protective shoelace storage compartment of claim 2 further comprising:

a plurality of said pair of opposing tongue openings formed in respective opposing positions in said first side edge and said second side edge of said tongue; and said shoelace threadable through said plurality of said pair of tongue openings to a criss-crossed engagement over said inner sidewall, from said attachment end toward said aperture, wherein substantially all of said shoelace may be enclosed in said storage pocket.

8. The protective shoelace storage compartment of claim 1 wherein said means for releasable closure of said aperture comprises:

a zipper having first and second sides attached to said aperture in said endwall edge;

a fabric overlay covering said first and second sides of said zipper; and said fabric overlay substantially covering said zipper entirely when said zipper is moved to a closed position with said first and second sides engaged thereby hiding said aperture from view.

9. The protective shoelace storage compartment of claim 8 wherein said means for attachment of said attachment edge adjacent to said toe end of said shoe is a means for releasable attachment whereby said tongue may be removed and reattached to said shoe.

10. The protective shoelace storage compartment of claim 8 further comprising:

a plurality of said pair of opposing tongue openings formed in respective opposing positions in said first side edge and said second side edge of said tongue; and said shoelace threadable through said plurality of said pair of tongue openings to a criss-crossed engagement over said inner sidewall, from said attachment end toward said aperture, wherein substantially all of said shoelace may be enclosed in said storage pocket.

11. The protective shoelace storage compartment of claim 1 wherein said means for attachment of said attachment edge adjacent to said toe end of said shoe is a means for releasable attachment whereby said tongue may be removed and reattached to said shoe.

12. The protective shoelace storage compartment of claim 11 further comprising:

a plurality of said pair of opposing tongue openings formed in said tongue; and said shoelace threadable through said plurality of said pair of tongue openings, from said attachment end toward said aperture, wherein substantially all of said shoelace may be enclosed in said storage pocket.

13. The protective shoelace storage compartment of claim 1 further comprising:

a plurality of said pair of opposing tongue openings formed in respective opposing positions in said first side edge and said second side edge of said tongue; and said shoelace threadable through said plurality of said pair of tongue openings to a criss-crossed engagement over said inner sidewall, from said attachment end toward said aperture, wherein substantially all of said shoelace may be enclosed in said storage pocket.

14. A shoe having a protective shoelace storage compartment comprising:

a shoe body having a toe end and a heal end and having a tongue situated in a tongue gap between two side sections of said shoe;

said tongue having an outer sidewall and an inner sidewall;

said outer sidewall and said inner sidewall joined along a first side edge and a second side edge and at an attachment edge;

means for attachment of said attachment edge adjacent to said toe end of said shoe;

said tongue having an aperture formed in an endwall edge, between said inner sidewall and said outer sidewall, opposite said attachment edge, said aperture extending along said endwall edge between a pair of opposing tongue openings in respective opposing positions in said first side edge and said second side edge adjacent to said endwall edge;

said aperture providing access to the entire length of a storage pocket, said storage pocket defined by said area between said inner sidewall and said outer sidewall, said first side edge, said second side edge, said attachment edge, and said endwall edge;

means for releasable closure of said aperture;

said pair of opposing tongue openings providing communication to said aperture for the distal ends of a shoelace used to secure said two side sections of said shoe said shoelace crossing over said outer sidewall from said attachment edge to respective engagement of said distal ends through said tongue openings;

said pair of opposing tongue openings engaged with said distal ends of said shoelace providing a means to maintain said tongue inline in said tongue gap from said attachment edge to said endwall edge; and an upper section of said storage pocket defined by the area between said tongue openings and said pair of sidewalls and said endwall edge, whereby said distal ends of said shoelace may be tied inside said upper section and said aperture closed thereby securing said distal ends inside said storage pocket.

* * * * *